US008040314B2

(12) United States Patent
Lee et al.

(10) Patent No.: US 8,040,314 B2
(45) Date of Patent: Oct. 18, 2011

(54) DRIVING APPARATUS FOR LIQUID CRYSTAL DISPLAY

(75) Inventors: Sang-Hoon Lee, Seoul (KR); Kook-Chul Moon, Yongin-si (KR); Chul-Ho Kim, Seoul (KR); Ung-Sik Kim, Suwon-si (KR); Pil-Mo Choi, Seoul (KR); Seock-Cheon Song, Suwon-si (KR); Ho-Suk Maeng, Seoul (KR); Keun-Woo Park, Seoul (KR)

(73) Assignee: Samsung Electronics Co., Ltd. (KR)

( * ) Notice: Subject to any disclaimer, the term of this patent is extended or adjusted under 35 U.S.C. 154(b) by 1281 days.

(21) Appl. No.: 11/543,533

(22) Filed: Oct. 4, 2006

(65) Prior Publication Data

US 2007/0109249 A1 May 17, 2007

(30) Foreign Application Priority Data

Nov. 16, 2005 (KR) ..... 10-2005-0109613

(51) Int. Cl.
*G09G 3/36* (2006.01)

(52) U.S. Cl. ..... 345/100; 345/98; 345/99; 345/101; 345/102; 345/103; 345/208

(58) Field of Classification Search ..... 345/87, 345/100, 92, 94, 96, 79, 88, 89
See application file for complete search history.

(56) References Cited

U.S. PATENT DOCUMENTS

| | | | | |
|---|---|---|---|---|
| 6,700,562 | B1 | 3/2004 | Knapp et al. | |
| 6,744,417 | B2 | 6/2004 | Yamashita | |
| 6,897,846 | B2 | 5/2005 | Youn et al. | |
| 2002/0080107 | A1 * | 6/2002 | Fujimoto et al. | 345/87 |
| 2005/0116944 | A1 | 6/2005 | Aoki et al. | |
| 2005/0179677 | A1 * | 8/2005 | Nojiri et al. | 345/204 |
| 2006/0187175 | A1 * | 8/2006 | Lo et al. | 345/100 |
| 2006/0232543 | A1 * | 10/2006 | Kobayashi et al. | 345/100 |
| 2009/0146920 | A1 * | 6/2009 | Miyake | 345/55 |

FOREIGN PATENT DOCUMENTS

| | | | |
|---|---|---|---|
| CN | 1246698 | | 3/2000 |
| CN | 1495496 | | 5/2004 |
| TW | 200521933 | A | 7/2005 |
| WO | 01/03104 | A | 1/2001 |
| WO | WO 2005/013252 | A1 * | 2/2005 |

* cited by examiner

*Primary Examiner* — Lun-Yi Lao
*Assistant Examiner* — Olga Merkoulova
(74) *Attorney, Agent, or Firm* — Innovation Counsel LLP

(57) ABSTRACT

A liquid crystal display having a plurality of pixels and blocks of shift registers that are connected to one another for temporarily storing data signals and from which the data signal outputs are sequentially applied to drive the pixels. Each of the shift registers receives a shift start signal and at least one of first and second clock signals, of which phases are opposite to each other, and a high period of the shift start signal corresponds to two cycles of the respective clock signals so that each pixel is pre-charged from the data signal from previous block of registers before receiving the data signal for the current block thereby preventing a boundary between blocks from being visually recognized.

19 Claims, 6 Drawing Sheets

DRIVING APPARATUS FOR LIQUID CRYSTAL DISPLAY

CROSS-REFERENCE TO RELATED APPLICATION

This application claims priority and benefit of Korean Patent Application No. 10-2005-0109613 filed in the Korean Intellectual Property Office on Nov. 16, 2005, the entire contents of which are incorporated herein by reference.

FIELD OF THE INVENTION

This invention relates to liquid crystal displays and, more particularly, to apparatus for driving the display.

DESCRIPTION OF THE RELATED ART

A typical liquid crystal display (LCD) includes two panels on which pixel electrodes and a common electrode are provided and a dielectrically anisotropic liquid crystal layer interposed between them. The pixel electrodes are arranged in a matrix and are connected to switching elements, such as thin film transistors (TFTs). Data signal voltages are applied to the pixel electrodes through the TFTs, row by row. A predetermined voltage is applied to the common electrode which covers an entire surface of one display panel. Each pixel electrode, the common electrode, and the liquid crystal layer form a one pixel liquid crystal capacitor. A liquid crystal display generally includes a gate driver that transmits gate signals that turns on/off the TFTs, a gray voltage generator that generates a plurality of gray voltages, a data driver that selects a voltage corresponding to image data among the gray voltages and applies the data voltage to data lines, and a signal controller. TFTs using low-temperature polycrystalline silicon have been employed in devices having 256 gray levels (8 bit) and 200 ppi (pixels per inch) resolution. However, to increase resolution and the number of gray levels would increase the size of the integrated circuit driving the crystal display making the COG—(chip on glass) type of IC that is mounted on a liquid crystal panel not suitable.

In order to reduce the size of the liquid crystal panel, it has been proposed to mount the shift register of the data driving IC on the liquid crystal panel and to mount the digital-to-analog converter, etc., on the signal controller, without using a data driving IC. These methods are classified as point-addressing mode and block-addressing mode depending on the driving mode of the shift register. In the point-addressing mode, a signal controller sequentially applies the data voltage to the pixel electrodes through the shift register. In the block-addressing mode, the shift register is divided into a predetermined number of blocks, and the data voltage is applied to the pixel electrodes through each of the blocks of the shift register.

The point-addressing mode can be used for low resolution. However, to achieve a resolution of more than 200 ppi, a high-performance thin film transistor is required. The block-addressing mode has almost no restrictions on the resolution, but the boundary between the blocks may appear in the liquid crystal panel if there is a difference of about 5 to 10 gray levels which may be recognized by the naked eye due to insufficient voltage charging of the pixel.

SUMMARY OF THE INVENTION

The present invention provides a driving apparatus for a liquid crystal display that hides the boundary between the data signals by temporarily storing the data signals in shift registers that sequentially provide outputs to the switching elements to pre-charge each block of pixel electrodes from the sequentially generated output of a previous block of shift registers. Each of the shift registers receives a shift start signal and at least one of first and second clock signals having opposite phase wherein the high period of the shift start signal lasts for two cycles of the respective clock signals and the output of each of the shift registers turns on each of the transmission gate units at least twice.

High periods of the outputs of the odd-numbered shift registers overlap each other at least one time, and high periods of the outputs of the even-numbered shift registers overlap each other at least one time. A data voltage is twice applied to a group of data lines connected to the same transmission gate unit, once for pre-charging from the data voltage applied to a group of lines connected to the previous shift register, and the second time for main charging performed by the data voltage from the current shift register. By performing pre-charging and main charging, it is possible to prevent the boundary between blocks from being recognized.

BRIEF DESCRIPTION OF THE DRAWINGS

The accompanying drawings briefly described below illustrate exemplary embodiments of the present invention and, together with the description, serve to explain the principles of the present invention.

DETAILED DESCRIPTION OF THE EMBODIMENTS

Figure 1:
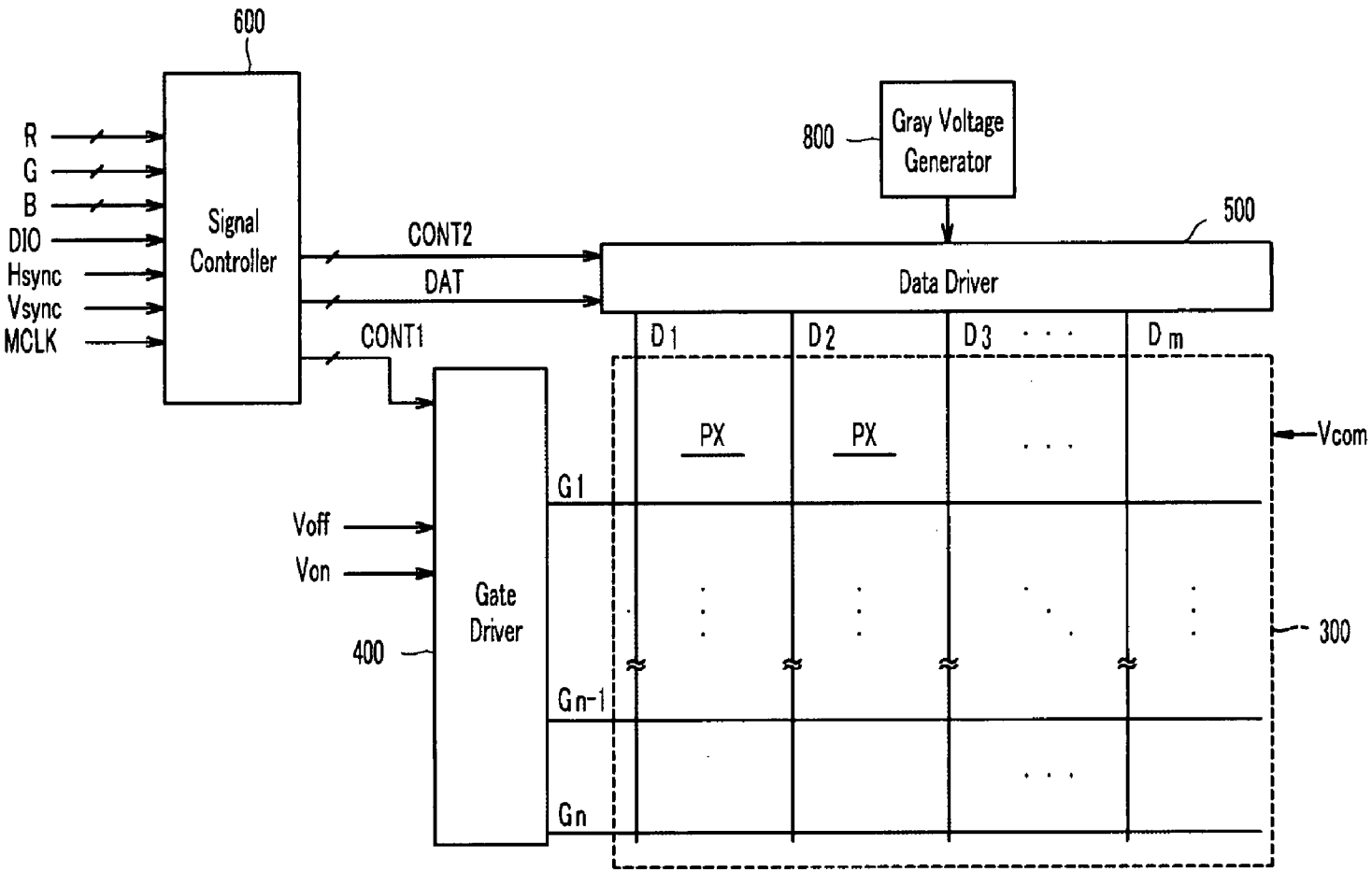
FIG. 1 is a block diagram of a liquid crystal display according to an exemplary embodiment of the present invention.

The present invention will be described more fully hereinafter with reference to the accompanying drawings, in which preferred embodiments of the invention are shown.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Figure 2:
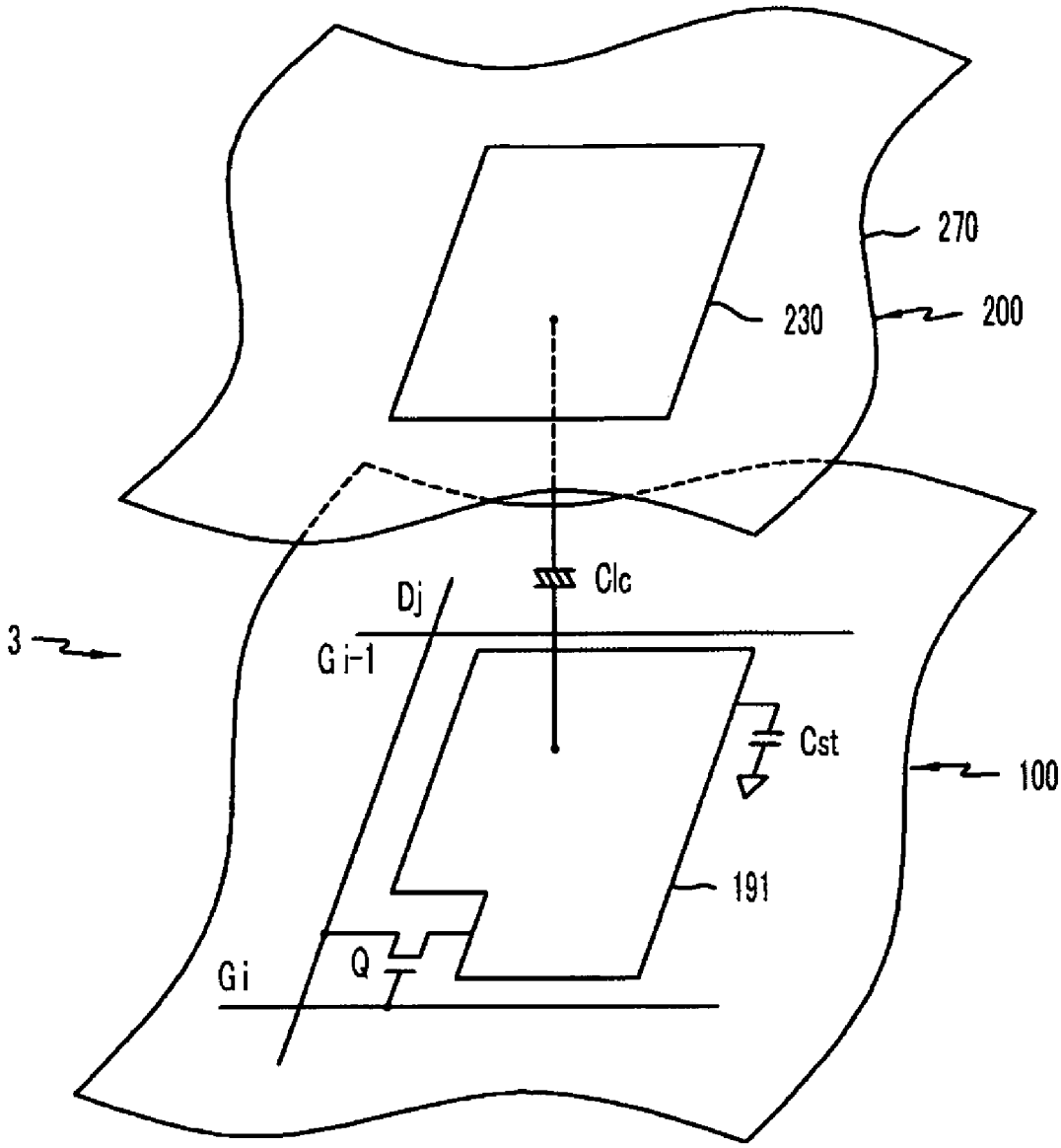
FIG. 2 is an equivalent circuit diagram of one pixel of the liquid crystal display.

First, a liquid crystal display according to an exemplary embodiment of the present invention will be described in detail with reference to FIGS. 1 and 2. FIG. 1 is a block diagram of a liquid crystal display according to an exemplary embodiment of the present invention, and FIG. 2 is an equivalent circuit diagram of one pixel of the liquid crystal display according to the exemplary embodiment of the present invention.

As shown in FIG. 1, the liquid crystal display includes a liquid crystal panel assembly 300, a gate driver 400 and a data driver 500 that are connected to the liquid crystal panel assembly 300, a gray voltage generator 800 that is connected to the data driver 500, and a signal controller 600 that controls the above-mentioned components.

As can be seen from an equivalent circuit, the liquid crystal panel assembly 300 includes a plurality of signal lines $G_1$ to $G_n$ and $D_1$ to $D_m$, and a plurality of pixels PX that are connected to the plurality of signal lines $G_1$ to $G_n$ and $D_1$ to $D_m$ and are substantially arranged in the form of a matrix. As shown in FIG. 2, the liquid crystal panel assembly 300 includes lower and upper panels 100 and 200 that face each other, and a liquid crystal layer 3 that is interposed between the lower and upper panels 100 and 200.

Signal lines $G_1$ to $G_n$ and $D_1$ to $D_m$ include a plurality of gate lines $G_1$ to $G_n$ that transmit gate signals (hereinafter, also referred to as "scanning signals"), and a plurality of data lines $D_1$ to $D_m$ that transmit data signals. The gate lines $G_1$ to $G_n$ substantially extend in a row direction and are substantially parallel to one another. The data lines $D_1$ to $D_m$ substantially extend in a column direction and are substantially parallel to one another.

Each pixel PX, for example, a pixel PX, which is connected to the i-th gate line $G_i$ (where i=1, 2, . . . , n) and the j-th data line $D_j$ (where j=1, 2, . . . , m), includes a switching element Q that is connected to the signal lines $G_i$ and $D_j$, and a liquid crystal capacitor Clc and a storage capacitor Cst that are connected to the switching element Q. The storage capacitor Cst may be omitted, if necessary.

Switching element Q is a three-terminal element such as a thin film transistor, provided on the lower panel 100, and includes a control terminal connected to the gate line $G_i$, an input terminal connected to the data line $D_j$, and an output terminal connected to the liquid crystal capacitor Clc and the storage capacitor Cst.

Pixel electrode 191 serves as one terminal of liquid crystal capacitor Clc and is on lower panel 100, common electrode 270 which serves as the other terminal is on the upper panel 200; liquid crystal layer 3 is interposed between the two electrodes 191 and 270 serves as the dielectric. Pixel electrode 191 is connected to switching element Q. Common electrode 270 is formed on the entire surface of the upper panel 200, and a common voltage Vcom is applied to common electrode 270. Unlike the pixel shown in FIG. 2, the common electrode 270 may be provided on the lower panel 100 in which case, at least one pixel electrode and the common electrode may be formed in a linear or bar shape.

Storage capacitor Cst is an auxiliary capacitor for the liquid crystal capacitor Clc. The storage capacitor Cst is configured such that a separate signal line (not shown) and the pixel electrode 191 that is provided on the lower panel 100 overlap through an insulator interposed therebetween. A predetermined voltage, such as the common voltage Vcom, is applied to the separate signal line. However, the storage capacitor Cst may be configured such that the pixel electrode 191 overlaps a previous gate line through the insulator.

In order to implement color display in the liquid crystal display, the individual pixels uniquely display one of the primary colors (spatial division) or the individual pixels sequentially display the primary colors (temporal division), such that a spatial or temporal sum of the primary colors is recognized as a desired color. The primary colors may be, for example, red, green, and blue. FIG. 2 shows an example of the spatial division. In FIG. 2, each pixel PX includes a color filter 230 representing one color of the primary colors in a region of the upper panel 200 corresponding to the pixel electrode 191. Unlike FIG. 2, the color filter 230 may be formed above or below the pixel electrode 191 of the lower panel 100. At least one polarizer (not shown) that polarizes light is attached to an outer surface of the liquid crystal panel assembly 300.

Returning to FIG. 1, gray voltage generator 800 generates two sets of gray voltages (or sets of reference gray voltages) related to the light transmittance of the pixel PX. One set of the two sets of gray voltages has a positive value with respect to the common voltage Vcom, and the other set has a negative value with respect to the common voltage Vcom.

Gate driver 400 is connected to the gate lines $G_1$ to $G_n$ and applies the gate signals obtained by combining a gate-on voltage Von and a gate-off voltage Voff.

Data driver 500 is connected to data lines $D_1$ to $D_m$ and selects the gray voltages generated by the gray voltage generator 800, and applies the selected gray voltages to the data line $D_1$ to $D_m$ as the data signals. However, gray voltage generator 800 instead of generating gray voltages for all of the gray levels may simply generate a predetermined number of reference gray voltages in which case data driver 500 interpolates among the reference gray voltages to generate the gray voltages for all the gray levels and selects the data signals from the gray voltages. Signal controller 600 controls the gate driver 400, the data driver 500, and so on.

Each of the driving devices 400, 500, 600, and 800 may be directly mounted on the liquid crystal panel assembly 300 as at least one IC chip or may be mounted on a flexible printed circuit film (not shown) and attached to the liquid crystal panel assembly 300 as a TCP (tape carrier package). Further, each driving device may be mounted on a separate printed circuit board (PCB) (not shown). Alternatively, these driving devices 400, 500, 600, and 800 may be integrated into the liquid display panel assembly 300, together with the signal lines $G_1$ to $G_n$ and $D_1$ to $D_m$, the thin film transistor switching elements Q, and so on. In addition, the driving devices 400, 500, 600, and 800 may be integrated into a single chip, but at least one of the driving devices 400, 500, 600, and 800 or at least one circuit element of the driving devices 400, 500, 600, and 800 may be provided outside of the single chip.

The operation of the above-mentioned the liquid crystal display will now be described in detail.

Signal controller 600 receives input image signals R, G, and B and input control signals for controlling display thereof from a graphics controller (not shown). The input control signals include, for example, a vertical synchronization signal Vsync, a horizontal synchronization signal Hsync, a main clock signal MCLK, and a data enable signal DE.

On the basis of the input image signals R, G, and B and the input control signals, signal controller 600 appropriately processes the input image signals R, G, and B in accordance with the operation conditions of the liquid crystal panel assembly 300 to generate a gate control signal CONT1, a data control signal CONT2, and so on. Then, signal controller 600 transmits the gate control signal CONT1 to the gate driver 400, and transmits the data control signal CONT2 and a processed image signal DAT to the data driver 500.

The gate control signal CONT1 includes a scanning start signal STV for instructing the start of scanning and at least one clock signal for controlling an output cycle of the gate-on voltage Von. The gate control signal CONT1 may further include an output enable signal OE for defining the duration of the gate-on voltage Von.

The data control signal CONT2 includes a horizontal synchronization start signal STH for informing of the start of data transmission for a row (group) of pixels PX, a load signal LOAD for instructing to apply the data signals to the data lines $D_1$ to $D_m$, and a data clock signal HCLK. The data control signal CONT2 may further include an inversion signal RVS for inverting the polarity of the voltage of the data signal with respect to the common voltage Vcom (hereinafter, simply referred to as "the polarity of the data signal").

In response to the data control signal CONT2 from signal controller 600, the data driver 500 receives the digital image signals DAT for a row (group) of pixels PX and selects the gray voltages corresponding to the individual digital image signals DAT. Then, the data driver 500 converts the digital image signals DAT into analog data signals, and applies the analog data signals to the data line $D_1$ to $D_m$.

The gate driver 400 applies the gate-on voltage Von to each of the gate lines $G_1$ to $G_n$ in response to the gate control signal CONT1 from signal controller 600, and turns on the switching element Q connected to each of the gate lines $G_1$ to $G_n$. Then, the data signals applied to the data lines $D_1$ to $D_m$ are transmitted to the pixels through the turned-on switching elements Q.

The difference between the voltage of the data signal and the common voltage Vcom applied to the pixel PX becomes a charging voltage of the liquid crystal capacitor Clc, that is, a pixel voltage. The magnitude of the pixel voltage determines the orientation of the liquid crystal molecules such that the polarization of light passing through the liquid crystal layer 3 is changed. The change of the polarization becomes a change in transmittance of light by a polarizer that is attached to the liquid crystal display panel assembly 300.

This process is repeated for every one horizontal period, which is also called "1H" and is equal to one cycle of the horizontal synchronization signal Hsync and the data enable signal DE. Then, the gate-on voltage Von is sequentially applied to all the gate lines $G_1$ to $G_n$, and the data signals are applied to all the pixels PX, thereby displaying images of one frame.

When the next frame starts after one frame is completed, the state of the inversion signal RVS that is applied to the data driver 500 is controlled such that the polarity of the data signal applied to each of the pixels PX is inverted ("frame inversion") with respect to the polarity of the previous frame. At this time, the polarity of the data signal that flows in one data line is inverted (for example, row inversion and dot inversion) or the polarities of the data signals that are applied to a row of pixels are inverted (for example, column inversion and dot inversion), according to the characteristics of the inversion signal RVS during one frame.

The structure and the operation of the liquid crystal display of another embodiment of the present invention will now be described with reference to FIGS. 3 to 5.

Figure 3:
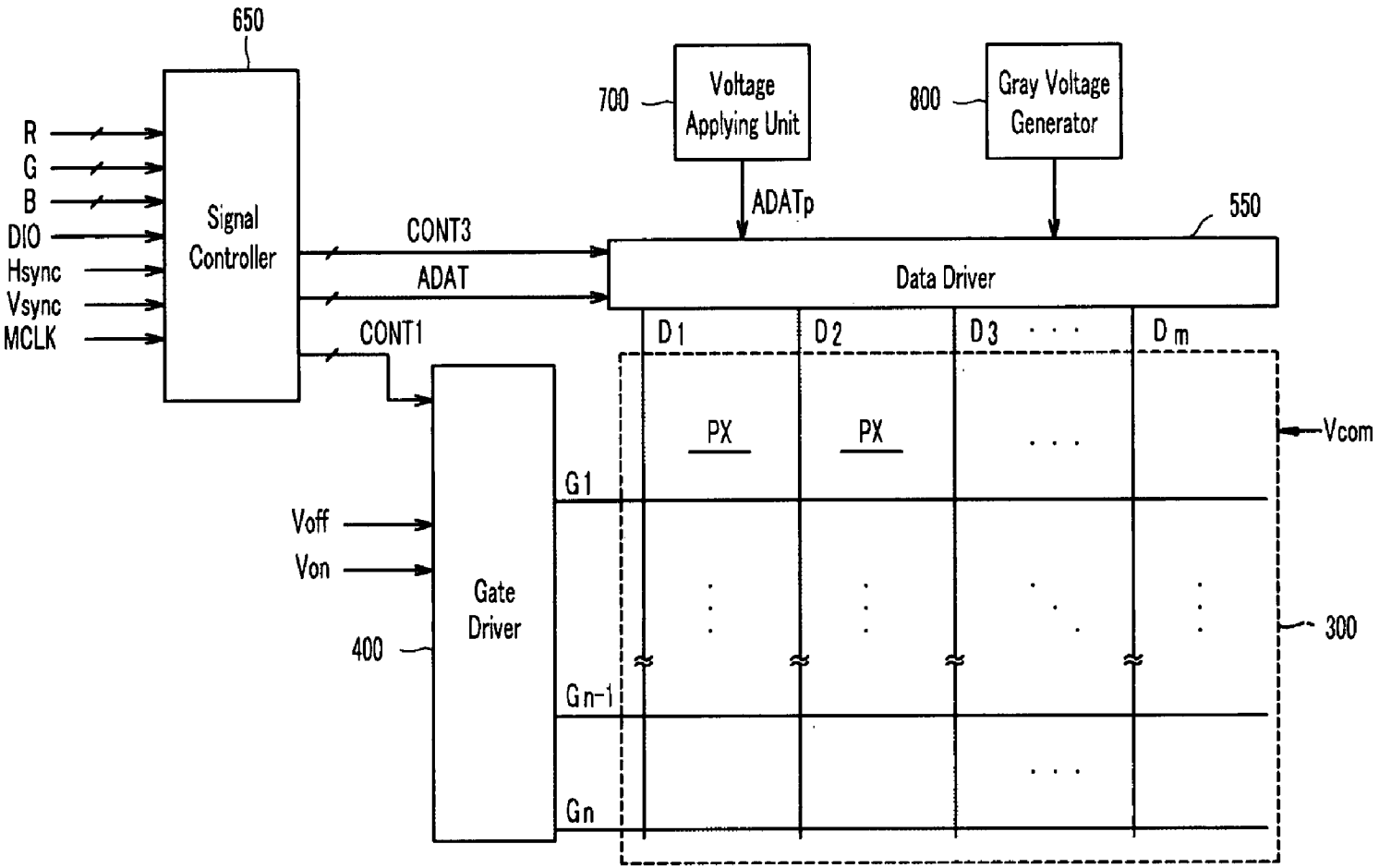
FIG. 3 is a block diagram of a liquid crystal display according to another embodiment of the present invention.
Figure 4A:
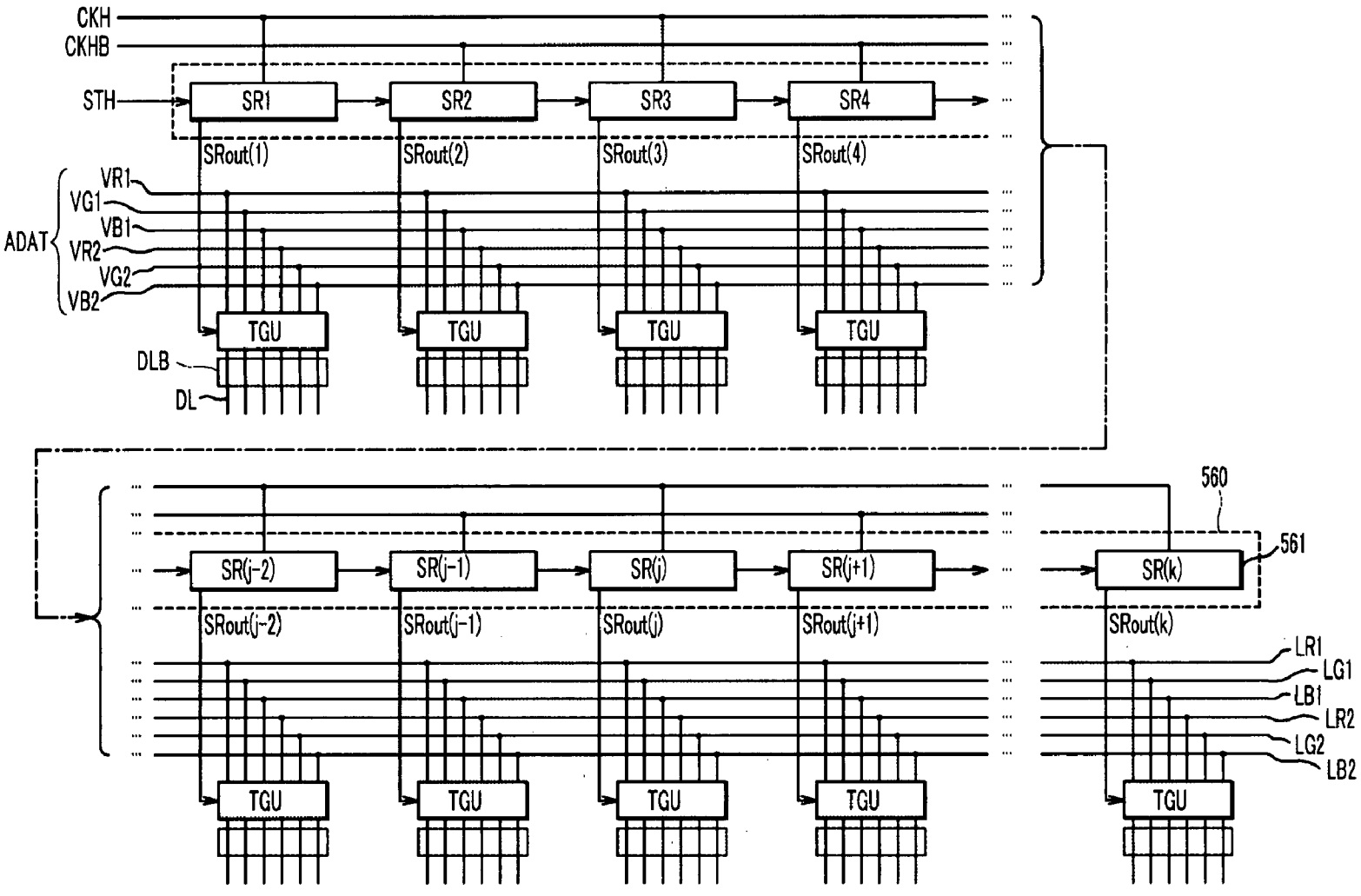
FIG. 4A is a block diagram of a data driver shown in FIG. 3.
Figure 4B:
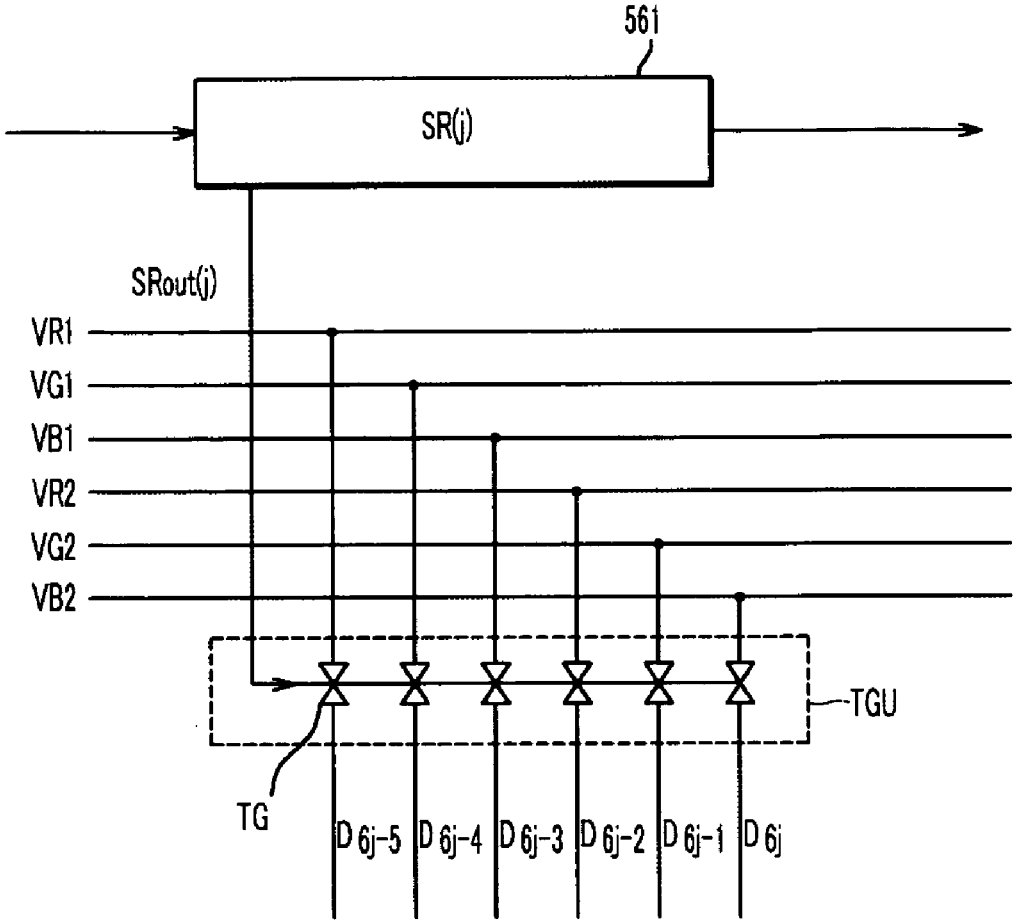
FIG. 4B is a diagram showing a transmission gate unit shown in FIG. 4A.
Figure 5:
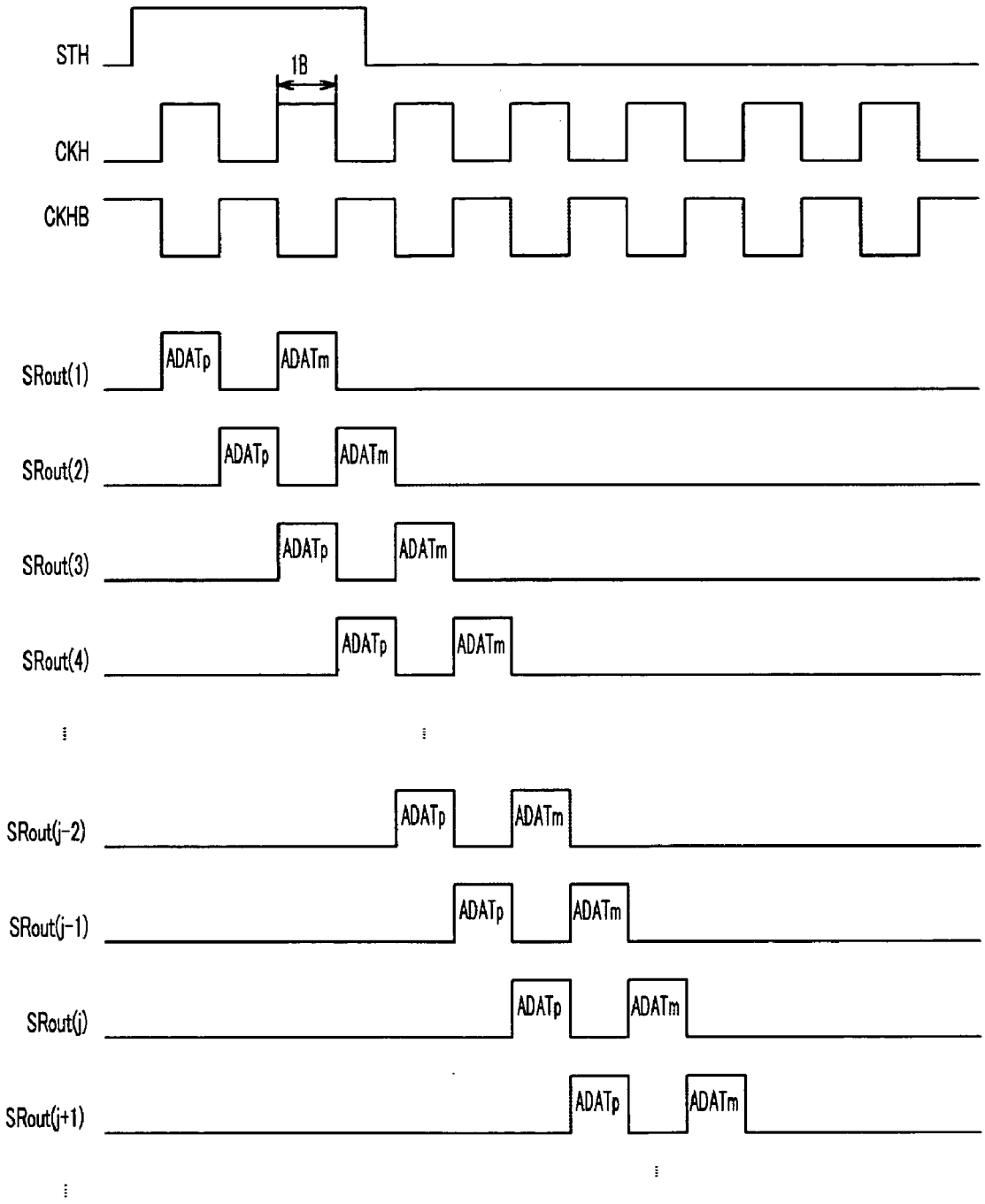
FIG. 5 is an output timing chart of a shift register shown in FIG. 4A.

FIG. 3 is a block diagram of the liquid crystal display according to another embodiment of the present invention, FIG. 4A is a block diagram of a data driver shown in FIG. 3, FIG. 4B is a circuit diagram of a transmission gate unit shown in FIG. 4A, and FIG. 5 is an output timing chart of the data driver shown in FIG. 3.

As shown in FIG. 3, the liquid crystal display according to another embodiment of the present invention includes a liquid crystal panel assembly 300, a gate driver 400 and a data driver 550 that are connected to the liquid crystal panel assembly 300, and a signal controller 650 that controls the above-mentioned components.

The liquid crystal panel assembly 300 and the gate driver 400 shown in FIG. 3 are substantially the same as those of FIG. 1, and thus the detailed descriptions thereof will be omitted. For convenience of explanation, the number of transmission gates is six in the following description, but it may be more than six.

A data driver 550 includes data voltage lines LR1, LG1, LB1, LR2, LG2, and LB2, a shift register unit 560 having a plurality of shift registers 561, and a plurality of transmission gate units TGU that are respectively connected to the shift registers 561.

The data voltage lines LR1, LG1, LB1, LR2, LG2, and LB2 are connected to a signal controller 650 and transmit data voltages VR1, VG1, VB1, VR2, VG2, and VB2 from the signal controller 650.

The shift register unit 560 includes the plurality of shift registers 561 that are arranged in a line. Further, the shift register unit 560 generates switching control signals SRout (1) to SRout(k) on the basis of a shift register control signal CONT3 from the signal controller 550, and then correspondingly applies the generated switching control signals SRout (1) to SRout(k) to the transmission gate units TGU.

Each of the transmission gate units TGU, for example the transmission gate unit TGU connected to the j-th shift register SR(j), includes six transmission gates TG. The input terminals of the six transmission gates TG are respectively connected to the data voltage lines LR1, LG1, LB1, LR2, LG2, and LB2, control terminals thereof are commonly connected to the corresponding shift register SR(j), and output terminals thereof are respectively connected to the data lines $D_{6j-5}$ to $D_{6j}$.

The transmission gate TG and the shift register unit 560 may be formed using thin film transistors including amorphous silicon or polycrystalline silicon semiconductors. In this case, the transmission gate TG and the shift register unit 560 may be directly formed in the liquid crystal panel assembly 300, together with the thin film transistor of the pixel PX.

The operation of the liquid crystal display having the above-described configuration, particularly the operation of the data driver 550, will now be described in detail.

In the following description, when the data line is not specified, reference numeral "DL" is used. Further, charging of the data line means that the data voltage is applied to the pixel connected to the data line so as to charge the pixel.

Like the above-described embodiment, the signal controller 650 receives input image signals R, G, and B and input control signals from an external graphics controller (not shown). Signal controller 650 appropriately processes the input image signal R, G and B in accordance with the operation conditions of the liquid crystal panel assembly 300 to generate analog data voltages VR1, VG1, VB1, VR2, VG2, and VB2, a gate control signal CONT1, and a shift resister control signal CONT3. Then signal controller 650 transmits gate control signal CONT1 to gate driver 400, and transmits data voltages VR1, VG1, VB1, VR2, VG2, and VB2 and the shift register control signal CONT3 to data driver 550.

Shift register control signal CONT3 includes, for example, a horizontal synchronization start signal STH and two clock signals CKH and CKHB for instructing to start the input of data voltages VR1, VG1, VB1, VR2, VG2, and VB2.

The clock signals CKH and CKHB have phases opposite to each other and have a duty ratio of 50%. Hereinafter, the time corresponding to a half cycle of each of the clock signals CKH and CKHB is referred to as '1B'. As shown in FIG. 5, the high period of the horizontal synchronization start signal STH corresponds to two cycles of the respective clock signals CKH and CKHB.

Each of the shift registers 561, for example, the j-th (where j is an odd number) shift register SR(j) receives the output of the previous shift register SR(j−1), generates an output SRout (j) after 1B, and then transmits the output SRout(j) to the next shift register SR(j+1) and the transmission gate unit TGU.

However, as shown in FIG. 4A, the first shift register SR1 generates the output SRout(1) in synchronization with the horizontal synchronization start signal STH. In this case, when the horizontal synchronization start signal STH is in a high level, the first shift register SR1 generates the output. When the horizontal synchronization start signal STH is in a low level, the first shift register SR1 does not generate the output.

Each of the odd-numbered shift registers transmits the output in synchronization with the clock signal CKH, and each of the even-numbered shift registers transmits the output in synchronization with the clock signal CKHB. In a case where the above-described j-th shift register SR(j) transmits the output signal SRout(j) in synchronization with the clock signal CKH, the shift registers SR(j−1) and SR(j+1) corresponding to the previous and next even-numbered shift registers transmit the output signals SRout(j−1) and SRout(j+1) in synchronization with the clock signal CKHB.

At this time, if the horizontal synchronization start signal STH input to the first shift register SR1 is in a high level, the first shift register SR1 generates a shift register output signal SRout(1) and applies the generated shift register output signal SRout(1) to the transmission gate unit TGU, as shown in FIG. 5. The transmission gate TG is turned on when the output signals SRout(1) to SRout(k) are at the high level, and is turned off when the output signals SRout 1 to SRout(k) are at the low level.

However, as shown in FIG. 5, since the respective output signals SRout 1 to SRout(k) have two high periods and one low period between the two high periods, the transmission gate unit TGU is turned on two times, and the data voltage is also applied to the data line connected thereto two times. At this time, for example, a second high period of the first shift register output signal SRout(1) and a first high period of the third shift register output signal SRout(3) overlap each other. Similarly, a second high period of the second shift register output signal SRout(2) and a first high period of the fourth shift register output signal SRout(4) overlap each other.

Since the transmission gate units TGU are connected to the same data voltage lines LR1, LG1, LB1, LR2, LG2, and LB2, a data voltage ADAT is applied to a group of data lines DLB connected to the same transmission gate unit TGU two times. Here, the data voltage ADAT applied in the first high period is used as a data voltage ADATp for pre-charging, and the data voltage ADAT applied in the second high period is used as a data voltage ADATm for main charging. That is, a group of data lines DLB are precharged by the data voltage ADATm that is applied to a group of data lines DLB connected to the previous shift register 561 through the transmission gate unit TGU for main charging, and main charging is performed by the data voltage ADAT that is applied after 1B.

However, since the first high periods of the first and second shift register output signals SRout(1) and SRout(2) do not have an overlap period, pre-charging is not performed. In this case, a separate data voltage applying unit 700 for pre-charging is provided, such that pre-charging of the data lines DL connected to the first and second shift registers SR1 and SR2 through the transmission gate units TGU can be performed. The voltage applying unit 700 may be provided in signal controller 600 or may be provided as a separate circuit.

As described above, if pre-charging and main charging are performed, it is possible to allow a boundary between blocks in a block addressing mode to be unrecognized. The boundary between the blocks is a phenomenon in which a difference of about 5 to 10 gray levels is recognized by the naked eye due to insufficient voltage charging of the pixel. Charging is completely performed by partial charging of the pixel through pre-charging and then main charging, such that the boundary between the blocks can be allowed to be unrecognized.

As described above, according to the embodiments of the present invention, it is possible to prevent the boundary between the blocks from being recognized by performing pre-charging and main charging.

While this invention has been described in connection with what is presently considered to be practical exemplary embodiments, it is to be understood that the invention is not limited to the disclosed embodiments, but, on the contrary, is intended to cover various modifications and equivalent arrangements that will be apparent to those skilled in the art.

What is claimed is:

1. A driving apparatus for a liquid crystal display that has a plurality of pixels, comprising:

a plurality of shift registers that are connected to one another, the plurality of shift registers generating first output signals, respectively; and transmission gate units, each having a plurality of transmission gates commonly connected to each of the shift registers, wherein each of the shift registers receives one of a shift start signal and the first output signal of a previous shift register of the plurality shift registers and at least one of first and second clock signals, phases of the first and second clock signals being opposite to each other, and a high period of the shift start signal corresponds to two cycles of the respective clock signals, each of the first output signals has at least two high periods in two cycles of the respective clock signals.

2. The driving apparatus for a liquid display device of claim 1, wherein the first output signal of each of the shift registers turns on each of the transmission gate units at least two times.

3. The driving apparatus for a liquid display device of claim 2, wherein each of odd-numbered shift registers among the shift registers generates the first output signal in synchronization with the first clock signal, and each of even-numbered shift registers generates the first output signal in synchronization with the second clock signal.

4. The driving apparatus for a liquid display device of claim 3, wherein high periods of the first output signals of the odd-numbered shift registers among the shift registers overlap each other at least one time, and high periods of the first output signals of the even-numbered shift registers overlap each other at least one time.

5. The driving apparatus for a liquid display device of claim 4, further comprising data voltage lines that are respectively connected to input terminals of the transmission gates and transmit an analog data voltage from the outside.

6. The driving apparatus for a liquid display device of claim 5, wherein the liquid crystal display further has data lines that transmit the data voltage to the pixels, and the data lines of as many as the number of data voltage lines are connected to each of the transmission gate units.

7. The driving apparatus for a liquid display device of claim 1, wherein each of the first output signals has first and second high periods, and the second high period of the first output of one shift register overlaps the first high periods of the first output signal of at least a portion of the next shift registers.

8. The driving apparatus for a liquid display device of claim 7, further comprising a voltage applying unit that supplies the data voltage during the first high periods of the first output signals of the first and second shift registers among the shift registers.

9. A liquid crystal display comprising:

a plurality of pixels and data lines that are connected to the pixels;

a plurality of shift registers that are connected to one another and sequentially generate first outputs; and transmission gate units, each having a plurality of transmission gates commonly connected to each of the shift registers, wherein each of the shift registers receives one of a shift start signal and the first output of a previous shift register and at least one of first and second clock signals whose phases are opposite to each other, and a high period of the shift start signal corresponds to two cycles of the respective clock signals, each of the first outputs of the shift registers has at least two high periods in two cycles of the respective clock signals.

10. The liquid crystal display of claim 9, wherein each of the first outputs of the shift registers turns on each of the transmission gate units at least two times.

11. The liquid crystal display of claim 10, wherein each of odd-numbered shift registers among the shift registers generates a first output signal in synchronization with the first clock signal, and each of even-numbered shift registers generates a second output signal in synchronization with the second clock signal.

12. The liquid crystal display of claim 11, wherein high periods of the first outputs of the odd-numbered shift registers among the shift registers overlap each other at least one time, and high periods of the first outputs of the even-numbered shift registers overlap each other at least one time.

13. The liquid crystal display of claim 12, further comprising data voltage lines that are connected to input terminals of the transmission gates and transmit an analog data voltage.

14. The liquid crystal display of claim 13, wherein the data lines of as many as the number of data voltage lines are connected to each of the transmission gate units.

15. The liquid crystal display of claim 14, further comprising a signal controller that supplies the analog data voltage.

16. The liquid crystal display of claim 9, wherein each of the first outputs of the shift registers has first and second high periods, and the second high period of the first output of one shift register overlaps the first high period of the first output of at least a portion of the next shift registers.

17. The liquid crystal display of claim 16, further comprising a voltage applying unit that supplies a data voltage during the first high periods of the first outputs of the first and second shift registers among the shift registers.

18. The liquid crystal device of claim 9, further comprising:

a liquid crystal panel assembly, on which the pixels and the data lines are provided, wherein the shift registers and the transmission gate units are integrated into the liquid crystal panel assembly.

19. The liquid crystal device of claim 9, wherein the pixels are formed of low-temperature polycrystalline silicon.

* * * * *